United States Patent [19]

Moench et al.

[11] 4,223,493

[45] Sep. 23, 1980

[54] MULTI-LAYERED SKYLIGHT

[75] Inventors: Theodor P. Moench, Griesheim; Friedrich Hanstein, Gross-Zimmern, both of Fed. Rep. of Germany

[73] Assignee: Röhm GmbH, Darmstadt, Fed. Rep. of Germany

[21] Appl. No.: 943,949

[22] Filed: Sep. 20, 1978

[30] Foreign Application Priority Data

Oct. 15, 1977 [DE] Fed. Rep. of Germany ..... 2746495

[51] Int. Cl.[2] ..... E04B 7/18; E04D 13/03

[52] U.S. Cl. ..... 52/200; 52/790

[58] Field of Search ..... 52/72, 200, 309.1, 788, 52/790

[56] References Cited

U.S. PATENT DOCUMENTS

| | | | |
|---|---|---|---|
| 2,918,023 | 12/1959 | Bettcher | 52/200 X |
| 3,127,699 | 4/1964 | Wasserman | 52/200 X |
| 3,307,303 | 3/1967 | Bloxom | 52/200 X |
| 3,350,823 | 11/1967 | Murray | 52/200 |

FOREIGN PATENT DOCUMENTS

| | | | |
|---|---|---|---|
| 2336747 | 2/1975 | Fed. Rep. of Germany | 52/200 |
| 7700507 | 7/1978 | Netherlands | 52/200 |
| 390510 | 8/1965 | Switzerland | 52/200 |
| 1188019 | 4/1970 | United Kingdom | 52/200 |
| 220462 | 3/1969 | U.S.S.R. | 52/200 |

*Primary Examiner*—Alfred C. Perham

*Attorney, Agent, or Firm*—Curtis, Morris & Safford

[57] ABSTRACT

A multi-layered skylight having an outer element with a central domed portion and a downwardly extending circumferential skirt portion, said outer element comprising a monolayer of a synthetic resin which transmits light, and an inner element of one-piece construction with a central domed portion and a substantially planar circumferential edge portion, said inner element comprising at least two sheets of a synthetic resin which transmits light, said sheets being substantially parallel to one another and having a plurality of supporting elements extending therebetween, said elements being arranged with the planar edge portion of said inner element being within and surrounded by the circumferential skirt portion of said outer element and with the central domed portions of said inner and outer elements being in a substantially parallel spaced relationship to one another.

7 Claims, 1 Drawing Figure

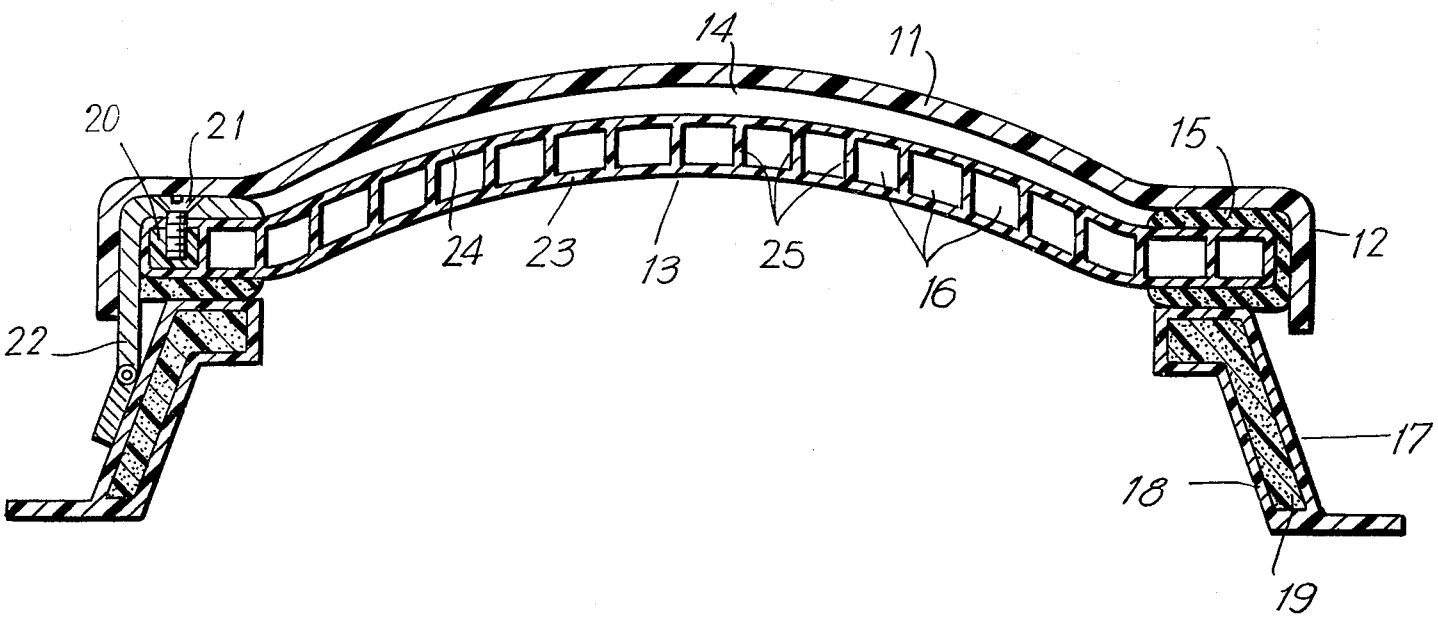
11
12
13
14
15
16
17
18
19
20
21
22
23
24
25

MULTI-LAYERED SKYLIGHT

The present invention relates to multi-layered skylights made of synthetic resin or resins which transmit light.

The multi-layer construction of the skylights of the invention improves the heat insulation of a space covered by the skylight and reduces the formation of condensation of water in the interior. For energy-saving reasons, it is desired to reduce the rate of heat transmission, K, of glazed installations to a value of less than 2.0 kcal/m$^2$h °C.; this value is prescribed by law in certain countries. Such a low rate of heat transmission cannot be attained with the known two-layered skylights. Only by using at least three layers is the aforementioned limiting value undercut. The preparation of three-layered skylights from three individually formed shell elements is, among other things, very expensive because the consumption of material is increased, more working steps are required, and the joinder of three shell elements in a technically satisfactory manner can only be achieved with complex means.

The object of the present invention is to prepare multi-layered skylight of a synthetic resin or resins which transmit light, i.e. are transparent or translucent, said skylight having a rate of heat transmission K, less than 2.0 kcal/m$^2$h °C. (determined by DIN 4701), such that the expenditure of material and labor in the preparation is fundamentally not larger than in the preparation of two-layered skylights.

The multi-layered skylight according to the present invention comprises an outer, dome-shaped, arched element having a drawn-down edge and an interior dome-shaped arched element the edge portions of which are bound to the outer element and are arranged within the drawn-down edge thereof and the remaining regions of which are in a spaced relationship from the outer element. The outer element comprises a monolayer of synthetic resin and the inner element consists of at least two parallel synthetic resin sheets having parallel spacer elements arranged therebetween and bound thereto to form a single piece.

The new skylights contain at least three synthetic resin layers which are separated one from another by air layers. For a three-layered skylight having an outer element which is 3 mm in thickness and having an inner element with two layers, each 1.5 mm thick, with air layers respectively 30 mm and 13 mm thick between the three layers, K has a value of 1.86 kcal/m$^2$h °C. calculated according to DIN 4701.

A better understanding of the present invention and of its many advantages will be had from the accompanying drawing which is a side view, in section, of a skylight according to the invention, shown seated in a mounting ring therefor.

FIG. 1 shows outer or exterior dome-shaped element 11 having edge portion 12 extending downwardly beyond the lower side of inner or interior dome-shaped element 13. When the skylight is installed, element 11 lies on the exterior of the building. However, its characterization as the "outer" element is based on the construction of the skylight itself, since downwardly-extending edge 12 extends beyond the underside of inner element 13, that is it completely encloses the latter with its rim 12.

Outer dome element 11 preferably is made of acrylic glass. It can be clear and transparent or it may have a textured surface, in this case preferably on the interior surface thereof. Likewise element 11 can be formed of a colored or translucent material and preferably contains an ultra-violet adsorbing additive; the latter is particularly appropriate if interior element 13 is made of a material, for example polyvinyl chloride, which is sensitive to ultra-violet light.

Inner element 13, which when installed faces the interior of the building, is dome shaped like the outer element and, to be sure, preferably so constructed that the separation between outer element 11 and inner element 13 is essentially uniform over the entire dome surface and is between 10 mm and 40 mm. A non-uniform separation, or one exceeding 40 mm, encourages the formation of convection currents in the air enclosed within space 14, whereby the rate of heat transmission is increased.

The inner and the outer elements are joined to each other in their edge portions, but are generally not directly adhered to one another or joined to one another by screws. Preferably, circumferential piece 15 having a U-shape and formed from an elastic material is put on the edge of inner element 13 which abuts the edge portions of the outer element. Preferably, U-shape insert 15 is adhered to both the inner and outer elements and in this way binds the elements of the skylight to each other.

Inner element 13 can be made of the same synthetic resin as outer element 11, that is, for example, an acrylic glass. It can however also differ in its surface structure, degree of opacity, or its coloration, or in the nature of the synthetic resin employed. A greater fire resistance is assured if the material of inner element 13 is a non-combustible or difficulty-combustible synthetic resin.

Since the synthetic resins which most often come into consideration for the inner and outer elements have a certain permeability to water vapor, water of condensation can form in interior space 14 and in chambers 16. This water of condensation evaporates more easily if the enclosed air spaces 14 and 16 are not hermetically sealed against the atmosphere.

U-shaped insert 15 is made to particular advantage of a material permeable to gas exchange, in particular an open-pored elastic foam material, for example foam rubber. Those surfaces thereof which are adhered should be so arranged that they do not block the diffusion path for gas exchange. U-shaped insert 15 can, when given suitable form, simultaneously serve as a gasket or seal to mounting ring 17 when mounting the skylight. Mounting ring 17 generally comprises outer shell 18, suitably of a synthetic resin such as a polyester, and core 19 of a foamed material, such as polyurethane foam.

Fittings, serving for attachment or for opening and closing the skylight, can be the same as those used in conventional one- or two-layered skylights. However, the skylights according to the present invention have the particular advantage that inner element 13 is already so rigid as a result of its two-layered construction that all fittings for the aforementioned purposes can be fastened solely to this element. If the fittings are screwed on, it is suitable to introduce screwing blocks 20, suitably of metal or of a tough plastic, in one chamber of inner element 13, into which fastening screws 21 are screwed through an aperture in the wall of the inner element. This type of attachment results in a reduced danger of breakage of double-walled element 13 than if the screw fittings are led completely through the element. U-shaped insert 15 can be opened at those portions where fittings, for example hinge 22, are attached. The advantage of attaching the fittings only to inner element 13 is that outer element 11 remains completely closed and the fittings, including the fastening screws, are protected against the influence of weathering. If this advantage is rejected, the fittings naturally can also be attached by screws through outer element 11 and U-shaped insert 15 to blocks 20.

Among the special advantages of the invention is the small consumption of material despite the two- or three-layered construction. Inner element 13 is prepared from a planar synthetic resin material comprising two or more parallel synthetic resin sheets (23, 24) and joining supports 25 bound thereto and arranged therebetween in a one-piece construction. Such a material can be prepared in planar form by extrusion of a suitable thermoplastic synthetic resin. The thickness of walls 23, 24 and supports 25 can be chosen to be so small that the weight per unit area of element 13 is no larger than that of single-shelled element 11, or may even be smaller. In this way, the material needed for this construction essentially corresponds to that required for a two-layered skylight.

The extruded multi-layer material of dome 13 can be formed into a dome in the same way as a one-layered material. During shaping using super-atmospheric pressure or vacuum while the resin is in a thermoelastic condition, care must be taken any excess pressure serving to form the material also prevails in hollow chambers 16 of the double-walled material. In case of vacuum forming, thus, chambers 16 must remain open to the atmosphere, whereas in pressure forming hollow chambers 16 are in communication with the source of compressed air. Doming of element 13 can be carried out to the desired height without a counter-die or mold element. The dome height is so adjusted with respect to the outer element 11 that, after assembly of the two elements, an essentially uniform separation or space 14, from 10 mm to 40 mm thick, results therebetween. The edge portion of inner element 13 in general remain planar and is not warmed before the forming step, so that the material can be grasped or fastened on the edge.

In the manufacture of skylights according to the present invention to have domed-shaped arched inner and outer elements, no more forming steps are necessary when operating in the manner described than for the preparation of known two-layered skylights. Finally, since a single U-shaped insert is sufficient for joining the shell elements to each other and for sealing the skylight with respect to its mounting ring, the finishing and mounting of the skylights according to the present invention require no greater expenditure of material and labor than for conventional two-layered constructions.

What is claimed is:

1. A multi-layered skylight having an outer element with a central domed portion, a substantially planar circumferential edge portion and a circumferential skirt portion extending downwardly from said edge portion, said outer element comprising a monolayer of a synthetic resin which transmits light, and an inner element of one-piececonstruction with a central domed portion and a substantially planar circumferential edge portion, said inner element comprising at least two sheets of a synthetic resin which transmits light, said sheets being closely spaced and parallel to one another, and having a plurality of elongated supporting elements integrally formed therewith and extending therebetween across the dimensions of said sheets between the substantially planar circumferential edge portions thereof and dividing the space between said sheets into a plurality of separate elongated chambers, said inner and outer elements being arranged with the planar edge portion of said inner element being located below the planar circumferential edge portion of the outer element within and surrounded by the circumferential skirt portion of said outer element, with the domed central portions of said inner and outer elements having substantially the same curvature and extending in substantially parallel spaced relationship to one another.

2. A skylight as in claim 1 wherein said inner and outer elements are substantially uniformly separated by a distance of 10 mm to 40 mm.

3. A skylight as in claim 1 which additionally comprises a circumferential gasket mounted on the edge portion of said inner element and extending therefrom to the skirt portion of said outer element.

4. A skylight as in claim 3 wherein said gasket is adhered to said inner and outer elements.

5. A skylight as in claim 3 wherein said gasket is comprised of an elastic open-pored foamed material.

6. A skylight as in claim 1 wherein said outer element is comprised of an acrylic glass and said inner element is comprised of polyvinyl chloride.

7. A skylight as in claim 1 which additionally comprises fittings for the mounting or the opening and closing thereof, said fittings being affixed to said inner element only.

* * * * *